United States Patent [19]

Brueck

[11] Patent Number: 4,653,233

[45] Date of Patent: Mar. 31, 1987

[54] MACHINE FOR GRINDING OF TORIC SURFACES ON OPTIC LENSES

[75] Inventor: Erhard Brueck, Heuchelheim, Fed. Rep. of Germany

[73] Assignee: Loh Optikmaschinen Kommanditgesellschaft, Oensingen/Solothurn, Fed. Rep. of Germany

[21] Appl. No.: 726,527

[22] Filed: Apr. 24, 1985

[30] Foreign Application Priority Data

Apr. 26, 1984 [EP] European Pat. Off. ..... 84104714.5

[51] Int. Cl.[4] ..... B24B 13/00

[52] U.S. Cl. ..... 51/124 L; 51/125.5

[58] Field of Search ..... 51/124 L, 125.5

[56] References Cited

U.S. PATENT DOCUMENTS 2,556,604 6/1951 Suddarth et al. ..... 51/124 L

*Primary Examiner*—Frederick R. Schmidt
*Assistant Examiner*—Robert A. Rose
*Attorney, Agent, or Firm*—Flynn, Thiel, Boutell & Tanis

[57] ABSTRACT

A machine for grinding of toric surfaces on optic lenses. A holder is provided for a lens ($L_1$) and is pivotally supported in a carriage of a compound support of two carriages. A swivel arm is secured to a pivot of a holder. The swivel arm is pivotal about a movable bearing. A holder for a grinding spindle with cup tool thereon is supported on the machine frame by means of a bearing ring. During a movement of the compound carriage, the workpiece holder moves due to the guiding of the swivel arm on a circular path, the radius of which determines the base curve of the torus surface. By supporting the weight of the holder through a compound support on the machine frame, bending stresses of the swivel arm are avoided, through which a high precision machining operation is achieved.

9 Claims, 6 Drawing Figures

MACHINE FOR GRINDING OF TORIC SURFACES ON OPTIC LENSES

FIELD OF THE INVENTION

The invention relates to a machine for grinding of toric surfaces on optic lenses.

BACKGROUND OF THE INVENTION

Machines of this type are often used for the manufacture of eye glasses, in particular for the socalled prescription manufacture, in which lenses are manufactured to order with a specific refractive power. In the case of toric surfaces, two radii must be maintained, namely, the first being the radius of the socalled base curve and the second being the radius of the socalled transverse curve. The base curve is determined in machines of the mentioned type by the length of the swivel arm and the transverse curve by the inclined position of the cup wheel. It is particularly important for the prescription manufacture that the two settings can be carried out quickly and precisely.

In a known machine of the abovementioned type (German AS No. 1 252 555), the first holder is on a swivel arm which projects cantilevered from a swivel bearing. A carriage is movable relative to the swivel axis on the swivel arm, which swivel axis carries an electric motor, on the shaft of which is coupled the cup tool. The second holder is movable in a carriage guide, which is shorter than the carriage, so that same can project beyond the guide. The considerable weight of the movable machine parts effect, depending on the adjustment position, various deformations, which leads to manufacture inexactnesses.

In order to avoid manufacture inexactnesses which are based on such deformations, a machine has also been produced (German Patent No. 22 52 498), in which the workpiece holder is movable on a straight guide and can be lifted and lowered at a right angle with respect to the guide, while the tool holder carries out only pivoting movements. A coordinating of the three movements occurs with the help of exchangeable control cams, which are scanned with sensitive feelers to control the pressure-medium supply to hydraulic drive cylinders. For this a considerable expenditure is needed. Also a large number of templates are needed. The machine is therefore expensive.

The basic purpose of the invention is to provide a machine of the abovementioned type wherein the machine parts are supported such that no deformations occur which are dependent on the respective adjustment position and which unfavorably influence the work result.

The purpose is attained inventively by the first holder being supported through a compound support on the machine frame, whereby the first holder is rotatable in the compound support and has a swivel arm which is connected fixed against rotation to it and along which a swivel-arm bearing is movable. The swivel-arm bearing consists of a swivel-arm holder which is rotatable relative to the machine frame together with the swivel arm and can be locked on same and of a swivel-arm bearing block which is nonrotatable relative to the machine frame, however, is movable in same and lockable on same.

In a so constructed machine, the swivel arm is not loaded by the weight of those parts which are connected to the swivel arm; this weight rather is transmitted through the compound support onto the machine frame. The swivel arm serves only as a guide plate which guides the first holder on the desired circular path. Deflections of the swivel arm by weight forces are thus completely avoided, so that precise work results are achieved in comparison with machines in which heavy weights effect different deformations at different adjustment positions. Since the movements are purely mechanically controlled, the machine suffices without any control-system expenditure to coordinate the movements. It is therefore extraordinarily simple. The adjustment occurs alone by movement of the swivel-arm bearing and by a corresponding rotation of the second holder. Template sets are therefore not needed. The radii can be changed in any desired small steps, which is advantageous in comparison to a machine which needs a separate template for each radius.

The swivel arm is structurally particularly simple and is located below the compound support in a housinglike constructed machine frame. The space below the machine is hereby utilized. The machine must have a certain construction height anyway in order to provide a comfortable working.

A particular locking mechanism has the advantage that adjusting operations are made easier, since the locking mechanism, without a careful adjusting according to scales, assures that the two guides, along which the swivel bearing must be moved, lie exactly parallel to one another. The locking mechanism can be constructed differently, such as by using pressure plates movable into and out of engagement with other components. The swivel bearing is moved preferably by means of a spindle which is arranged in the housing. Such a spindle can both be driven manually and also by means of an electric motor. The respective position of the swivel bearing can for example be indicated by means of a counter, which indicates the rotations of the adjusting spindle.

In order for the effective length of the swivel arm to be able to change, a locking is created between the swivel bearing and the swivel arm. A particularly advantageous embodiment, which can be operated by compressed air, can be utilized. A remote operation is comfortably possible with such a means. However, it is also conceivable to carry out the locking directly by hand. The swivel drive for the first holder can be done manually by a suitable movement on the compound support. This is easily practical, since the rough grinding of the lens, which rough grinding is to be created with the machine, is carried out generally in one single pass. However, a drive by a motor is preferred.

According to a further development of the invention, the second holder has a bearing ring which rests on the machine frame and which encircles the compound support. Through this the second holder is supported very strongly on the machine frame. Upon rotation of the bearing ring for the purpose of adjustment of the transverse curve, the weight stresses do not change, so that also no different deformation at different adjustment positions occur. It is advantageous to provide a mechanism on the bearing ring which can create an air cushion below the bearing ring. With this a rotation of the bearing ring during adjustment operations is made substantially much easier. After removal of the air cushion, the bearing ring due to its heavy weight rests fixedly on the machine frame, so that a further locking is not needed.

BRIEF DESCRIPTION OF THE DRAWINGS

The drawings illustrate in FIGS. 1 and 2 the principle of manufacture of concave and convex toric lens surfaces and in FIGS. 3 to 6 one exemplary embodiment of a lens-grinding machine. More specifically.

DETAILED DESCRIPTION

Figure 1:
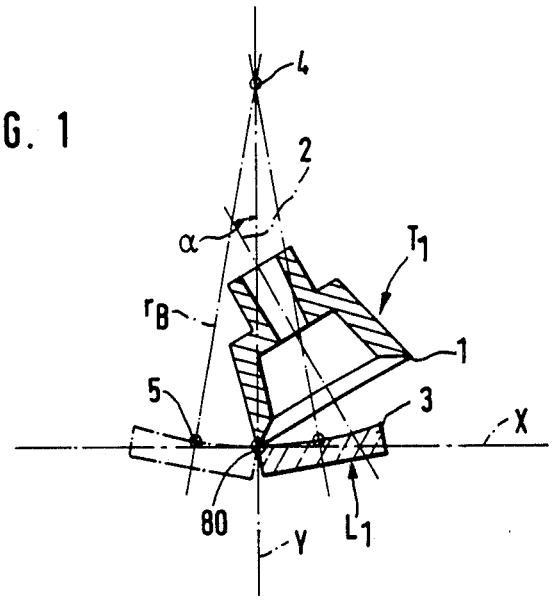
FIG. 1 illustrates the manufacturing principle for a concave toric lens surface.

FIG. 1 illustrates in cross section a cup tool $T_1$. The cup tool has a circular cutting edge 1 and can be driven at a high speed about an axis of rotation 2. A lens $L_1$ is to be worked with the cup tool $T_1$, that is, a concave-toric surface 3 is to be created on the lens. The lens $L_1$ is mounted in a lens holder pivotal about a stationary point 4 on a circular path, so that the entire lens surface 3 passes the cutting edge 1. One end position of the lens $L_1$ is illustrated with full lines and the other end position with dashed lines. The lens $L_1$ is shown in a diametral cross section, so that there the base curve appears as a line of intersection through the concave-toric surface, the radius of which base curve is identified by $r_B$ in FIG. 1. The radius $r_B$ equals the distance between points 4 and 5.

The transverse curve is determined by the inclined position of the axis of rotation 2 relative to the Y-axis. The larger the inclined-position angle $\alpha$, the smaller is the radius of the transverse curve. If the angle $\alpha$ is 90°, then the radius of the transverse curve equals the radius of the cutting edge 1. A transverse curve with yet a smaller radius cannot be created with a given cup wheel $T_1$. The smaller the angle $\alpha$, the larger will be the radius of the transverse curve. However, it is practically impossible to adjust an exact infinite radius with a cup wheel, thus to create as a lens surface 3 a pure cylinder surface.

From looking at FIG. 1 it can be seen that the distance between the points 4 and 5 must be changed when the radius $r_B$ of the base curve is to be changed. Thus, if the cup wheel $T_1$ is only swingable, however, not substantially movable, the point 4 must be moved for this purpose.

During the manufacture of convex surfaces, a cup tool $T_2$ (see FIG. 2) is used and which has a cutting edge 6. In this case the cutting edge 6 engages the lens with the inner edge of the face of the tool. The lens $L_2$ is held such that it is pivotal about a fixed point 4'. The radius $r'_B$ equals the distance between the points 4' and 5'. Also in this case the radius of the transverse curve is determined by the inclined-position angle $\alpha'$ of the axis 2' of the cup tool $T_2$ relative to the Y-axis.

The machine which will be described hereinafter works according to the principle which is explained in connection with FIGS. 1 and 2. The manufacture of a concave lens surface is illustrated in the drawing in connection with the machine illustration.

The machine has a machine frame 7 with a lower part *7a* and an upper part *7b*. The machine frame 7 carries a compound support which is identified as a whole by the reference numeral 8, and on which is arranged a first holder 9. A second holder 10 is supported by a bearing ring 11 on the upper part *7b* of the machine frame. Within the housinglike constructed machine frame 7 there is provided a swivel-arm bearing which is identified as a whole by the reference numeral 12 and about which a swivel arm 13 can be rotated. The condition and cooperation of these parts will be described in detail hereinafter.

Figure 4:
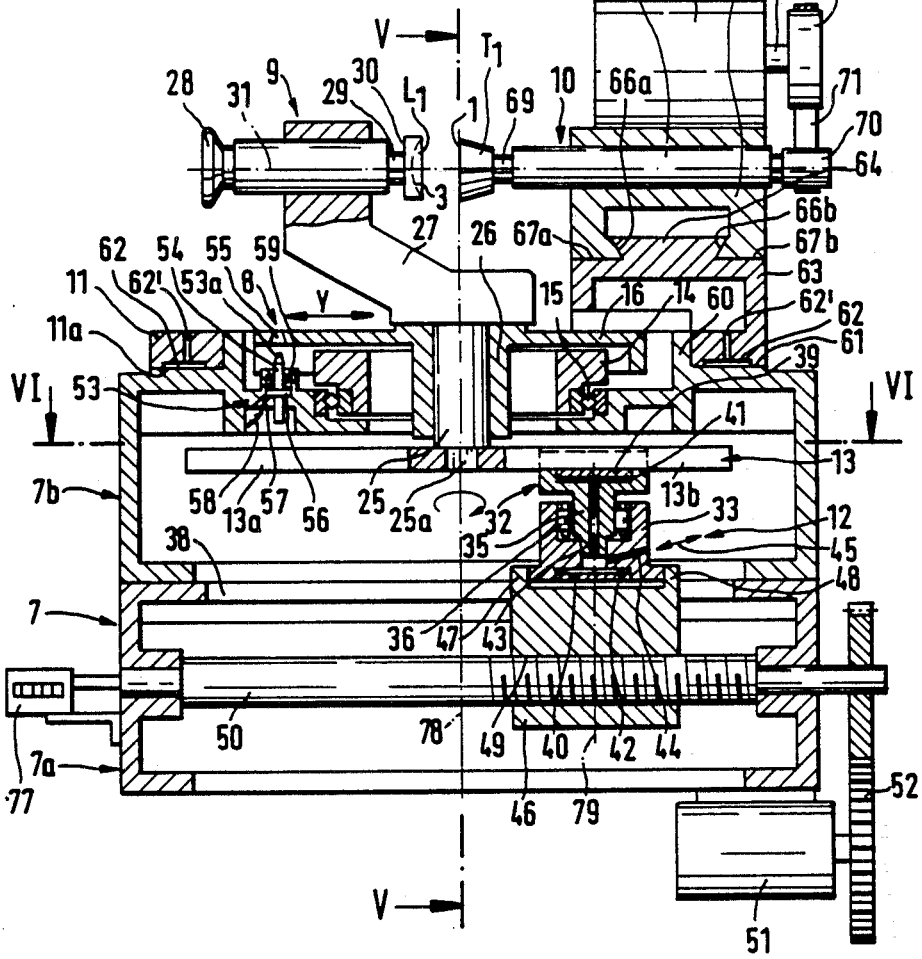
FIG. 4 is a vertical cross-sectional view taken along the lines IV—IV of FIGS. 3 and 5, whereby FIG. 4, to simplify the drawing, shows for the second holder a zero angle of traverse, while in FIG. 3 the second holder assumes an angle which differs from the zero angle of traverse.
Figure 5:
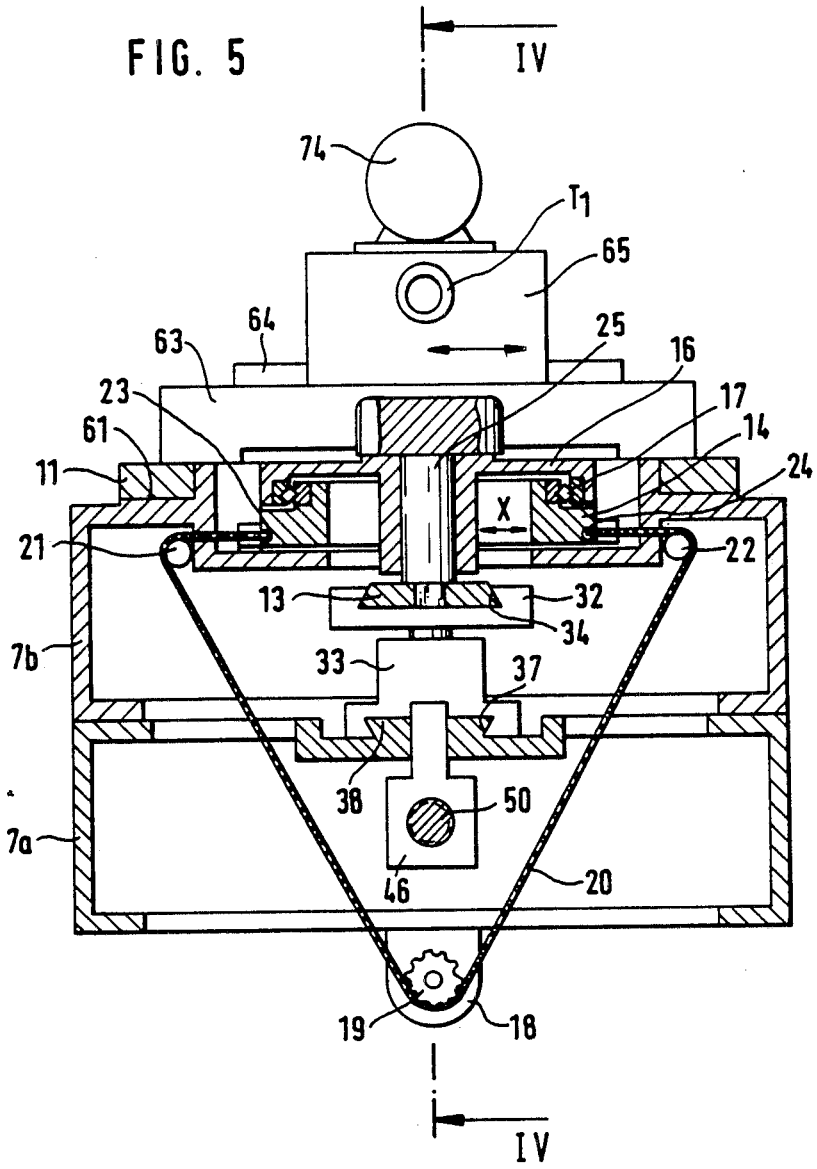
FIG. 5 is a vertical cross-sectional view taken along the line V—V of FIG. 4.
Figure 6:
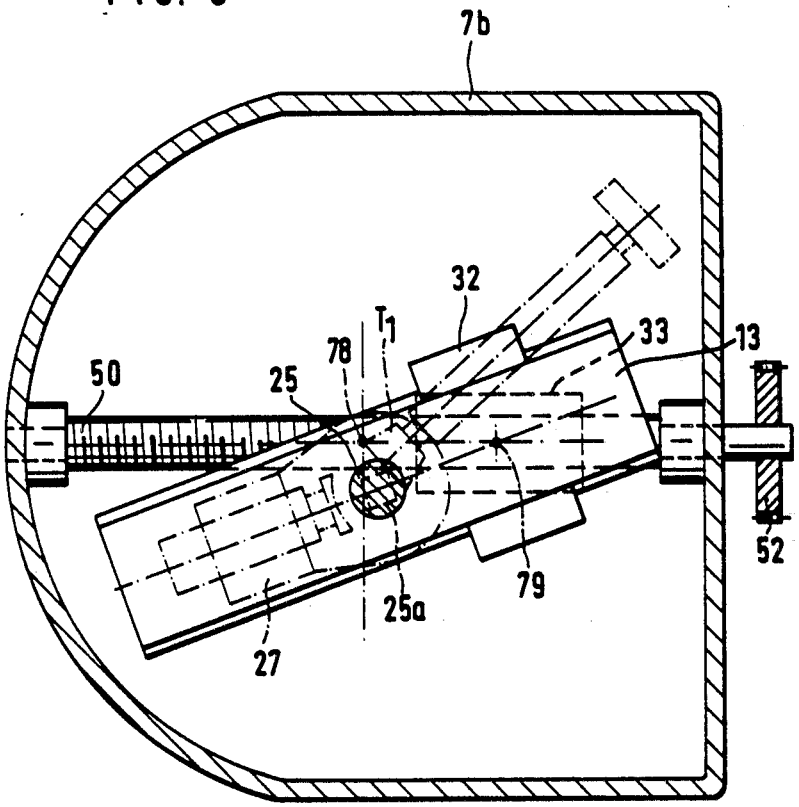
FIG. 6 is a horizontal cross-sectional view taken along the line VI—VI of FIG. 4.

The compound support 8 has a first carriage 14, which is guided for a straight path movement by a roller guide 15 on the machine frame upper part *7b*. A second carriage 16 is guided for a straight path movement by means of a roller guide 17 on the first carriage 14 (see FIG. 5). The guideways 15 and 17 are exactly perpendicular to one another. The direction of movement of the first carriage 14 is identified by an X (FIG. 5) and the direction of movement of the second carriage 16 by a Y (FIG. 4). The first carriage 14 can be driven by an electric motor 18, which is a geared motor and carries a sprocket wheel 19 on its driven shaft, over which sprocket wheel 19 is placed a chain 20. The chain 20 is guided over guide sprockets 21, 22 and is connected at its ends to fastening points 23 and 24 on the first carriage 14.

The first holder 9 is rotatably supported in the second carriage 16 by means of a pin 25 provided on the holder and which is received in a bearing sleeve 26 provided on the second carriage 16. An arm 27 projects from the pin 25 and carries a rod 29 which is movable by means of a handwheel 28 and on which is provided a lens holder 30. The lens holder 30 is movable along the axis 31 for adjustment purposes. The swivel arm 13 is secured to the lower end of the pin 25. The swivel arm cannot be rotated relative to the pin 25 due to the square connection *25a* therebetween. The swivel arm 13 extends symmetrically with respect to its fastening point. The two sections are identified by the reference numerals *13a* and *13b*.

The swivel-arm bearing 12 consists of a swivel-arm holder 32 and a swivel-arm bearing block 33. As one can see from the cross section according to FIG. 5, the swivel arm 13 has a dovetail-shaped cross section received in a groove 34 in the swivel-arm holder 32. The groove 34 also has a dovetail-shaped cross section. A pivot pin 35 is provided on the swivel-arm holder 32, which pivot pin is rotatably supported in the swivel-arm bearing block 33 by a roller bearing 36. The bearing block 33 has (see FIG. 5) a guide groove 37 thereon with a dovetail-shaped cross section. A guide bar 38 has a dovetail-shaped cross sectioned part received in the groove. The guide groove 37 is provided on the machine frame lower part *7a*.

The swivel-arm holder 32 can be locked or clamped to the swivel arm 13 and the bearing block 33 can be locked or clamped to the guide bar 38. Pressure plates 39 and 40 are provided for this purpose. The pressure plate 39 is provided in a chamber 41 within the swivel-arm holder 32 and the pressure plate 40 within a chamber 42 in the bearing block 33. The two chambers communicate with one another through a bore 43 provided in the swivel-arm holder 32. Compressed air can be fed to the two chambers 41 and 42 through a bore 44. The compressed-air infeed and the compressed-air discharge is illustrated symbolically by a double arrow 45. When the chambers 41, 42 are pressurized with compressed air, the pressure plate 39 is pressed into engagement with the swivel arm 13 and the pressure plate 40 into engagement with the guide bar 38, after which engagements movement of the bearing block and the swivel-arm holder is no longer possible.

A slide part 46 grips around the bearing block 33, for which purpose noses 47, 48 are provided on the slide part 46. The slide part 46 has an internal thread 49, into which engages an adjusting spindle 50. The adjusting spindle 50 is rotatably supported, however, axially non-movably in the machine frame lower part *7a*. The adjusting spindle can be driven by means of an electric motor 51, which is drivingly coupled to the spindle through a reduction gear 52.

The compound support 8 can be locked with respect to the machine frame 7 by means of a locking mechanism 53. The locking mechanism includes a locking bolt 54, the front end 53*a* of which is conical in shape and which is received in a conical hole 55 in the second carriage 16. To move the locking bolt into the locking position, a pressure-medium cylinder 56 is provided, to which cylinder pressure medium can be fed through a bore 57. The pressure-medium supply and the pressure-medium discharge is symbolized by a double arrow 58. A spring 59 serves to urge the locking bolt 54 back into the release position.

A guide collar 60 is provided on the machine frame upper part *7b*, on which guide collar 60 is centered the bearing ring 11. The bearing ring 11 has a bottom surface 11*a* supported on a support surface 61 on the machine frame upper part *7b*. Between the bottom surface 11*a* and the support surface 61 there are spaces 62 into which compressed air can be introduced through bores 62' which terminate in the chambers.

A block 63 is mounted on the bearing ring 11. A guide bar 64 is provided on the block 63. The guide bar 64 has a dovetail-shaped cross section. A carriage 65 is guided on the guide bar 64, which carriage has guide surfaces 66*a* and 66*b* which are conformed to the guide bar 64. The weight of the carriage is supported on support surfaces 67*a*, 67*b* of the block 63.

A grinding spindle 68 is held in the carriage 65, in which grinding spindle is supported a spindle shaft 69. A belt pulley 70 is provided at the rear end of the spindle shaft 69 and is driven by means of a driving belt 71 by a belt pulley 72 fixed to the shaft 73 of an electric motor 74. A cup tool $T_1$ is mounted at the front end of the spindle shaft 69.

A scale 75 is provided on the machine frame upper part *7b*, which scale cooperates with a mark 76 on the bearing ring 11. The scale 75 is divided into angle degrees. The spindle shaft 50 is coupled with a counter 77 which indicates the number of rotations of the adjusting spindle 70 also in small fractions of rotations.

OPERATION

The machine operates as follows. Prior to the start of work, the machine is adjusted in accordance with the lens $L_1$ which is to be manufactured. Prior to adjusting the point 4 (see FIG. 1), the locking bolt 54 is moved into the bore 55 by a pressure loading of the pressure-medium cylinder 56. The locking hole 55 is arranged relative to the locking bolt 54 such that when the locking bolt is in the locking position, the swivel arm 13 is exactly parallel with respect to the guide bar 38. For facilitating an adjustment, the chambers 41, 42 are relieved of compressed air, so that the swivel-arm holder 32 is movable on the swivel arm 13 and the bearing block 33 is movable on the guide bar 38. Movement occurs by rotating the spindle 50 by means of the electric motor 51. The distance between the axes 78 and 79 is read at the counter 77. The counter is calibrated such that it indicates this distance directly in millimeters. If the distance equals the desired radius $r_B$ (see FIG. 1), the drive of the spindle is stopped and the chambers 41, 42 are loaded with compressed air. The swivel-arm holder 32 is through this locked or clamped on the swivel arm and the bearing block 33 is locked or clamped on the guide bar 38. The position of the point 4 (see FIG. 1) is thus fixed.

The bearing ring 11 is now rotated corresponding with the desired transverse curve of the lens surface 3, whereby the mark 76 is aligned with the corresponding graduation division on the scale 75. Prior to the rotation of the rotating ring 11, the chambers 62 are pressurized, whereby an air film forms between the surfaces 11*a* and 61, which permits a rotation of the bearing ring 11 with little force. When the desired adjustment has been determined, the compressed air is discharged from the chambers 62, so that the bearing ring 11 rests on the support surface 61 with a high frictional force.

Figure 3:
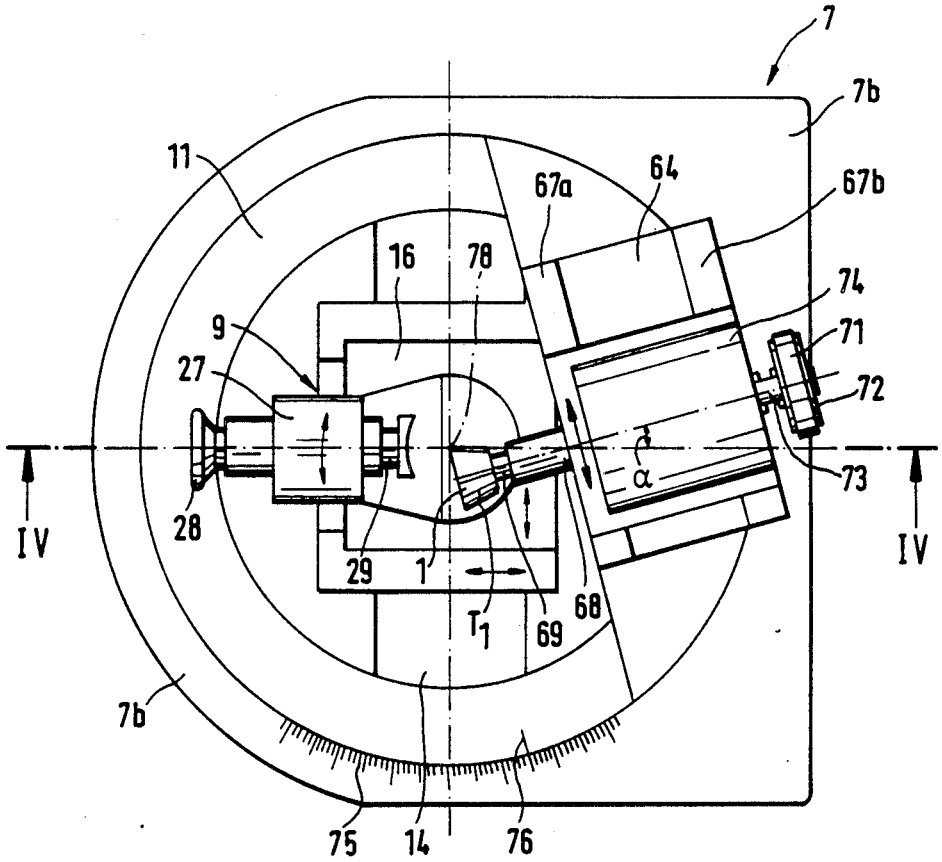
FIG. 3 is a top view of a lens-grinding machine for the manufacture of toric lens surfaces.

By turning the hand wheel 28, the rod 29 is adjusted in accordance with the lens thickness. The carriage 65 is moved into a position whereat the cutting edge 1 of the cup tool $T_1$ lies in the axis 78 (see FIG. 3). Also the grinding spindle 68 can be moved along its axis in order to bring same into the correct position following wear on the cutting edge.

Prior to the start of work, the locking bolt 54 is pulled out of the locking bore 55 by relieving the pressure in the pressure-medium cylinder 56. The grinding spindle 68 is started by turning on the electric motor 74 and the drive of the carriage 14 is started by turning on the electric motor 18.

The electric motor 18 effects a movement of the carriage 14, so that the carriage carries out a rectilinear movement in the X direction. The second carriage 16 moves at the same time relative to the first carriage 14 at a right angle with respect to same. This is effected by the swivel arm 13, which guides the pin 25 on a circular path. The second carriage moves in the Y direction. The coupling of the two carriages 14 and 16 to the swivel arm 13 effects a composition of the carriage movements in the X and Y directions to one circular path.

It is clear from viewing the drawing, that the weight of the first holder 9 is supported through the compound support 8 on the machine frame *7b* without the swivel arm 13 being loaded by weight forces. The swivel arm 13 has only the purpose to guide the first holder 9 in a circular path. During the movement of the holder 9 on the circular path the cutting edge 1 of the cup tool $T_1$ cuts a toric surface into the lens $L_1$. The radius of the transverse curve depends on the inclined position angle $\alpha$ of the tool and on the radius of the cutting edge 1. The radius $r_B$ depends on the distance between the axes 79 and 78. The axis 79 corresponds with the point 4 in FIG. 1 and the axis 78 with the point in FIG. 1 which is identified by the reference numeral 80.

Figure 2:
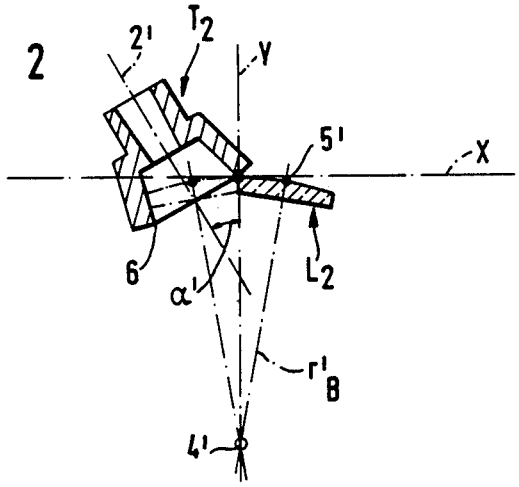
FIG. 2 illustrates the manufacturing principle for a convex toric lens surface.

When a convex toric surface corresponding with FIG. 2 is to be created, the bearing block 33 together with the swivel-arm holder 32 is adjusted into a position left of the axis 78 (see FIG. 4).

Thus, during this case of machining, the section 13*a* of the swivel arm is in use.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a machine for grinding of toric surfaces on optic lenses having a machine frame, a first holder and a second holder, a headstock having a tool spindle which carries a cup tool mounted on one of said first and second holders and a receiving mechanism, for the lens which is to be worked, mounted on the other of said first and second holders, said first holder being pivotal about a first axis, first adjusting means for adjusting the distance between said first axis and a cutting point on said cup tool so that the distance corresponds with the desired radius of a base curve of said torus surface, and second adjusting means for adjusting said second holder so that the desired radius of a transverse curve of said torus surface is adjusted about a second axis, the improvement comprising wherein said second holder has a bearing ring which is rotatably supported on said machine frame and which encircles said compound support means, wherein a compound support means is provided on said frame means, said compound support means including a pair of carriages, each supported for rectilinear movement along mutually perpendicular axes, wherein rotatable support means is provided on said compound support means for rotatably supporting said first holder about said first axis, said first holder having a swivel arm which is connected fixed against rotation thereto and arranged below a swivel-arm bearing means movable along the length of said swivel arm, said swivel-arm bearing means consisting of a swivel-arm holder mounted on and being rotatable relative to said machine frame and with said swivel arm, locking means for locking said swivel-arm holder to said machine frame and said swivel arm and a swivel-arm bearing block nonrotatable relative to said machine frame, however, is linearly movable on said frame means and is positionally lockable on said frame means.

2. The machine according to claim 1, wherein a further locking means is provided for locking said first holder relative to said machine frame and against rotation during a positioning of said swivel arm when said swivel arm extends parallel to a carriage guide arranged fixedly in said machine frame, said swivel-arm bearing block being movable along said carriage guide.

3. The machine according to claim 2, wherein said further locking means has a locking bolt which is movably supported on said machine frame, and which can be introduced into a locking hole on said first holder by means of a pressure-medium cylinder.

4. The machine according to claim 1, wherein said swivel-arm bearing block is movable by means of a spindle rotatably supported on said machine frame, said spindle operatively engaging a spindle nut on said swivel-arm bearing block.

5. The machine according to claim 2, wherein for locking said swivel-arm holder and said swivel-arm bearing block, pressure plates are provided in said swivel-arm holder and in said swivel-arm bearing block, which pressure plates can be pressed by means of compressed air into engagement with at least one of said swivel arm and said swivel-arm bearing block.

6. The machine according to claim 1, wherein said first holder has a motor driven swivel drive.

7. The machine according to claim 6, wherein said swivel drive engages a carriage of said compound support means moves substantially perpendicularly with respect to said swivel arm.

8. The machine according to claim 1, wherein in the area of a support surface on said bearing ring there are arranged chambers, to which compressed air can be fed in order to form, below said bearing ring, an air bearing to make the rotation of said bearing easier.

9. The machine according to claim 1, wherein said first axis is coaxial with an axis about which said bearing ring is rotatable.

* * * * *